US009386840B2

(12) United States Patent
Huang et al.

(10) Patent No.: US 9,386,840 B2
(45) Date of Patent: Jul. 12, 2016

(54) ADVANCE FEED DISPENSER

(76) Inventors: Kuo Yu Huang, Guangzhou (CN); Zoilo Luis Alviar, Everett, WA (US)

( * ) Notice: Subject to any disclaimer, the term of this patent is extended or adjusted under 35 U.S.C. 154(b) by 126 days.

(21) Appl. No.: 14/356,871

(22) PCT Filed: Dec. 12, 2011

(86) PCT No.: PCT/CN2011/083827

§ 371 (c)(1),
(2), (4) Date: May 7, 2014

(87) PCT Pub. No.: WO2013/086673

PCT Pub. Date: Jun. 20, 2013

(65) Prior Publication Data

US 2014/0314464 A1 Oct. 23, 2014

(51) Int. Cl.

| | |
|---|---|
| ***B43K 5/16*** | (2006.01) |
| ***A45D 40/26*** | (2006.01) |
| ***A45D 40/06*** | (2006.01) |
| ***A45D 33/02*** | (2006.01) |
| ***A45D 33/12*** | (2006.01) |
| ***A45D 33/14*** | (2006.01) |
| ***A45D 33/36*** | (2006.01) |
| ***A45D 34/04*** | (2006.01) |
| *A45D 33/34* | (2006.01) |
| *A46B 11/00* | (2006.01) |

(52) U.S. Cl.

CPC ..... *A45D 40/26* (2013.01); *A45D 33/02* (2013.01); *A45D 33/12* (2013.01); *A45D 33/14* (2013.01); *A45D 33/36* (2013.01); *A45D 34/041* (2013.01); *A45D 34/042* (2013.01); *A45D 40/06* (2013.01); *A45D 33/34* (2013.01); *A45D 2200/054* (2013.01); *A45D 2200/1009* (2013.01); *A46B 11/0024* (2013.01); *A46B 11/0027* (2013.01)

(58) Field of Classification Search

CPC ..... A45D 33/14; A45D 33/34; A45D 33/36; A46B 11/0024; A46B 11/0027

USPC ..... 401/277

See application file for complete search history.

(56) References Cited

U.S. PATENT DOCUMENTS 3,008,172 A * 11/1961 Thompson ..... A47L 23/05 401/149
4,906,120 A * 3/1990 Sekiguchi ..... A46B 11/0024 401/146

(Continued)

FOREIGN PATENT DOCUMENTS

CN 1238731 A 12/1999
CN 201073072 6/2008

(Continued)

OTHER PUBLICATIONS

International Search Report and Written Opinion, International Application No. PCT/CN2011/083827, mailed Oct. 4, 2012, 12 pages.

*Primary Examiner* — Jennifer C Chiang
(74) *Attorney, Agent, or Firm* — Timberline Patent Law Group

(57) ABSTRACT

Representative implementations of devices and techniques provide dispensing and/or application of product from a reservoir of an applicator device or dispenser. A feeder device disposed within the reservoir expels the product from the reservoir when the feeder device is advanced from a first position to a second position within the reservoir. An applicator may be coupled to the reservoir to apply product expelled from the reservoir.

17 Claims, 8 Drawing Sheets

(56) References Cited

U.S. PATENT DOCUMENTS

| | | | | |
|---|---|---|---|---|
| 5,851,079 | A | 12/1998 | Horstman et al. | |
| 7,275,885 | B2 * | 10/2007 | Byun | A45D 33/02 401/278 |
| 2008/0237932 | A1 | 10/2008 | Tani | |

FOREIGN PATENT DOCUMENTS

| | | |
|---|---|---|
| CN | 201234704 | 5/2009 |
| CN | 201870004 U | 6/2011 |

* cited by examiner

ADVANCE FEED DISPENSER

BACKGROUND

Cosmetic materials such as those used for cosmetic foundation or color are typically provided as a compacted or loose powder. Loose materials, including loose powders, are common for cosmetic use due in part to the fact that loose material often provides desired coverage of the material on a surface such as human skin. The loose material may be provided in various types of containers of myriad configurations.

Common container configurations include open containers or containers with perforated surfaces or sifters so that the powder may be shaken out of the perforations and the powder can then be applied onto an applicator. These configurations can be problematic in that the loose material may have a tendency to spill during handling. Consequently, some of these containers are prone to waste. Additionally, applicators can be misplaced or unavailable for use when needed. Further, measuring out desired quantities of loose materials for use can be very difficult with many types of containers, meaning that there may not be enough product on an applicator or there may be too much product on the applicator for a particular use.

SUMMARY

This disclosure relates to applicator devices or dispensers usable for holding and dispensing among other things powdered or powder-like cosmetic products. According to one exemplary implementation, an applicator device is disclosed that has a reservoir configured to contain a product, such as a powdered or powder-like product, where a first end of the reservoir is sealed to prevent the product from escaping the reservoir. In one embodiment, an end cap is coupled to the first end of the reservoir. A feeder device is disposed within the reservoir and configured to expel the product from the second end of the reservoir when the feeder device is advanced from a first position to a second position within the reservoir. In one embodiment, the feeder device is a feeder screw, and the product is expelled from the second end of the reservoir when the feeder screw is rotated. An applicator is coupled to the second end of the reservoir for applying the product expelled from the reservoir.

One embodiment also includes an applicator holder or nozzle coupled to the second end of the reservoir and providing a channel for the product to be expelled from the reservoir. In an embodiment, the applicator holder secures an applicator (such as a brush, a sponge, etc.) to the applicator device and operates as a conduit to deliver product to the applicator. Further embodiments include one or more actuators coupled to the feeder device and or feedback devices which help control advancement of the feeder device within the reservoir and/or provide feedback to a user during operation.

According to another exemplary implementation, an applicator device is configured to be filled from the bottom (or first end) of the applicator device. In such an implementation, an end cap may be used to seal the bottom of the applicator device after filling the applicator device.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Representative implementations of devices and techniques provide dispensing and/or application of product from a reservoir of an applicator device or dispenser. According to one exemplary implementation, a feeder device disposed within the reservoir expels the product from the reservoir when the feeder device is advanced from a first position to a second position within the reservoir. Additionally, an applicator may be coupled to the reservoir to apply product expelled from the reservoir.

Various implementations of applicator devices and techniques are discussed in this disclosure. The applicator devices and techniques are discussed with reference to example implementations illustrated in the figures. The applicator devices, dispensers, and techniques discussed herein are referred to in the context of cosmetics, such as those used for cosmetic foundation or color, for ease of discussion and illustrative convenience. The applicator devices, dispensers, and/or techniques may also be used in other contexts, in other environments, with other implementations, and associated with other products, systems, and the like, to provide application, dispensing, and/or distribution of various products (e.g., medicines, health products, nutritional supplements, adhesives, lubricants, solvents, artistic media, etc.).

Further, example implementations of applicator devices, dispensers, and techniques are discussed with reference to powder or powder-like products, also for ease of discussion. The devices and techniques described herein can also be applicable to products having various other solid, semi-solid, or liquid forms, and remain within the scope of the disclosure.

Implementations are explained in detail below using a plurality of examples. Although various implementations and examples are discussed here and below, further implementations and examples may be possible by combining the features and elements of individual implementations and examples.

Example Embodiments

Figure 1:
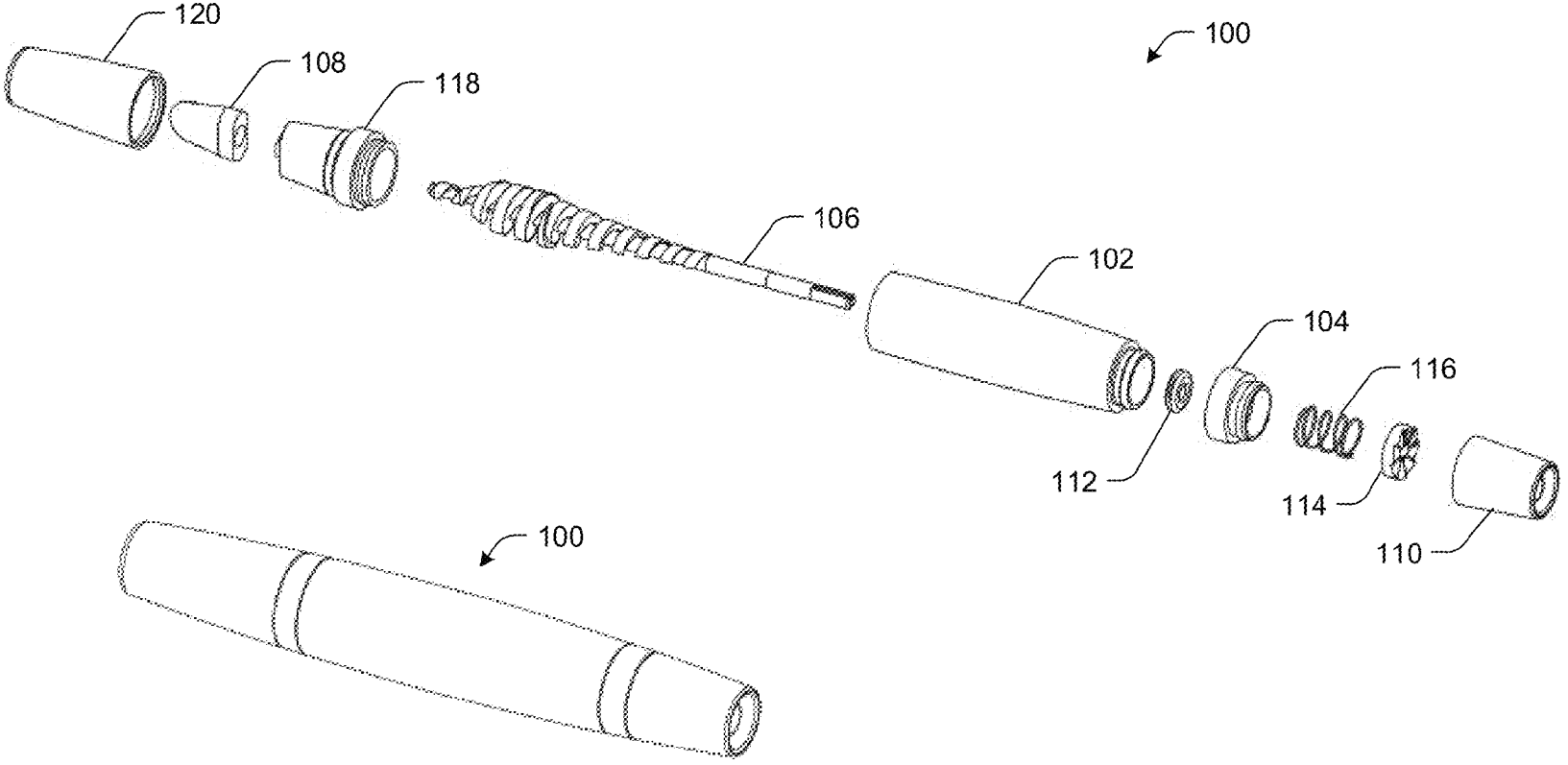
FIG. 1 includes a perspective view and an exploded view of an example applicator device, in which the techniques and devices in accordance with the present disclosure may be embodied.
Figure 2:
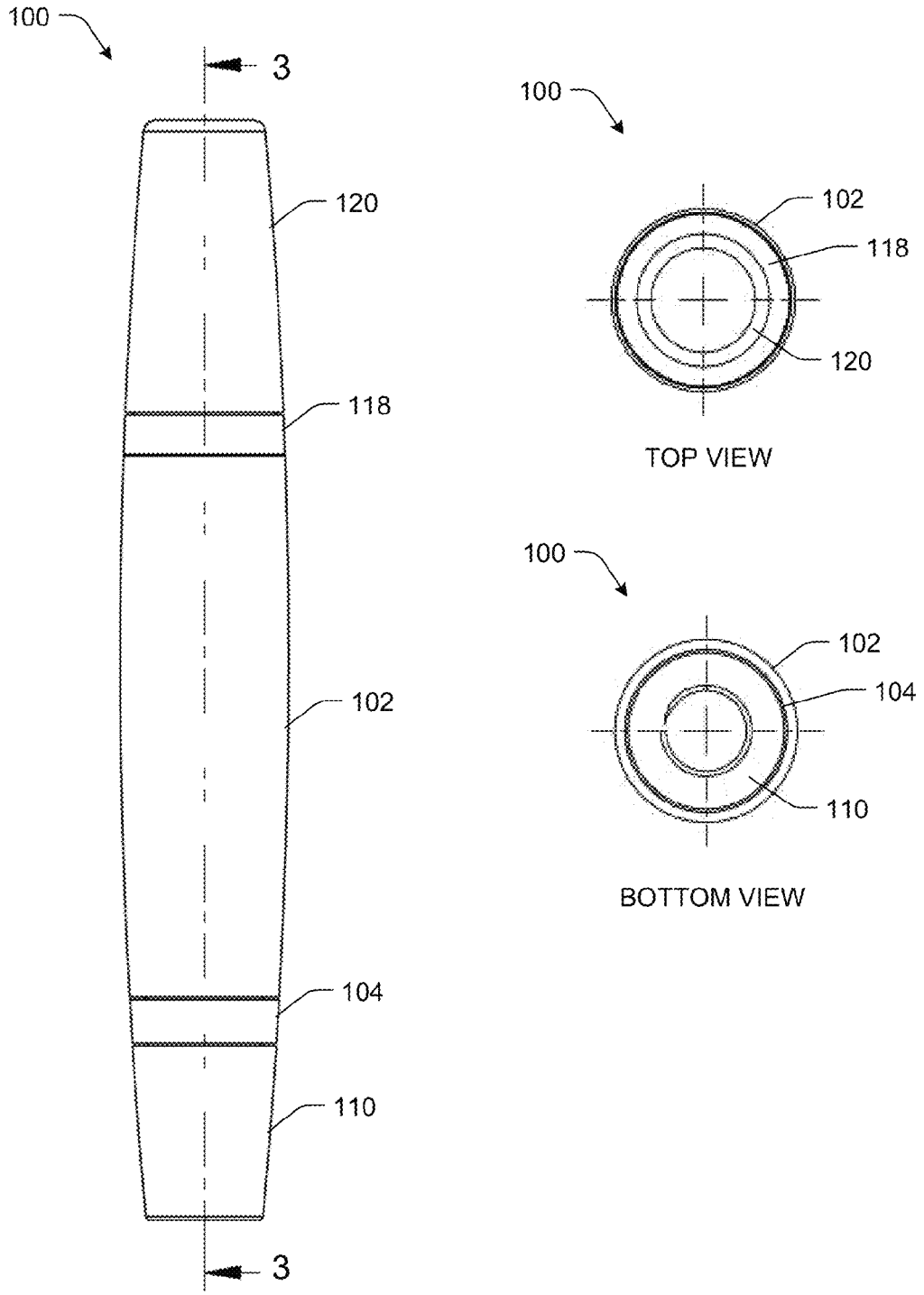
FIG. 2 includes plan and profile views of an example applicator device implemented as in FIG. 1. The views include a side view, a top view, and a bottom view.
Figure 3:
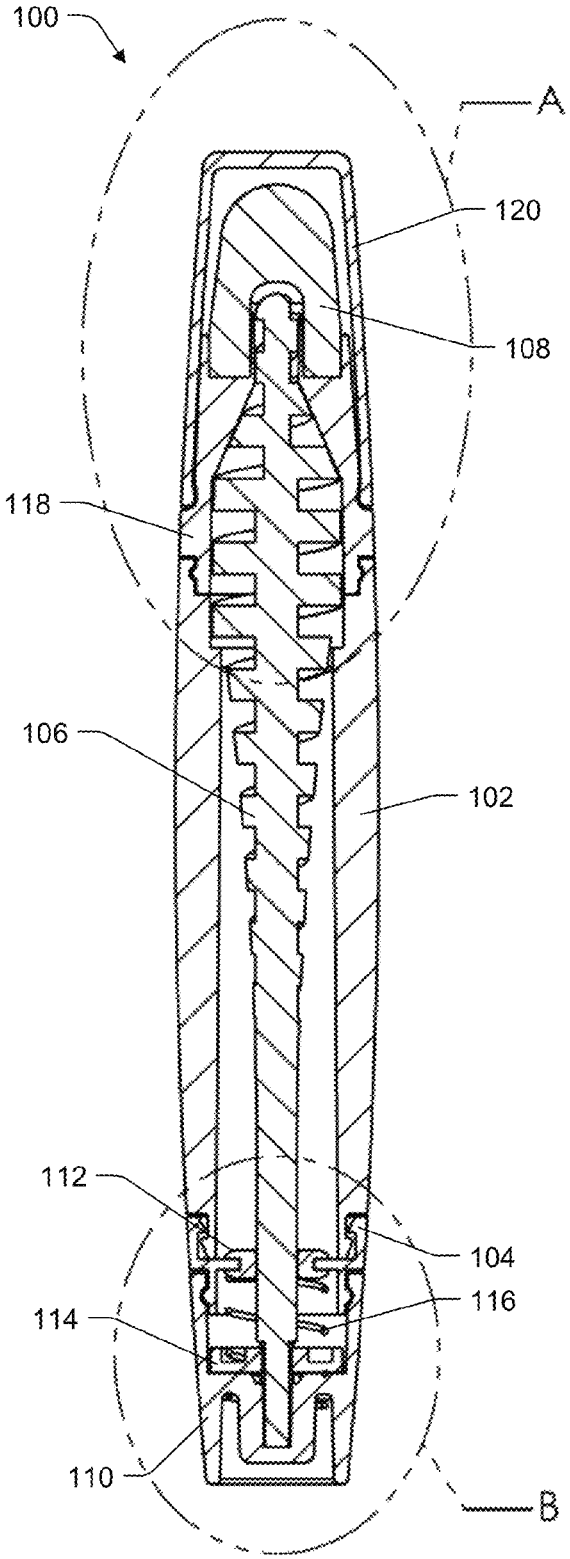
FIG. 3 is a cross-sectional profile view of an example applicator device implemented as in FIG. 1, taken along line 3-3 in FIG. 2.
Figure 4:
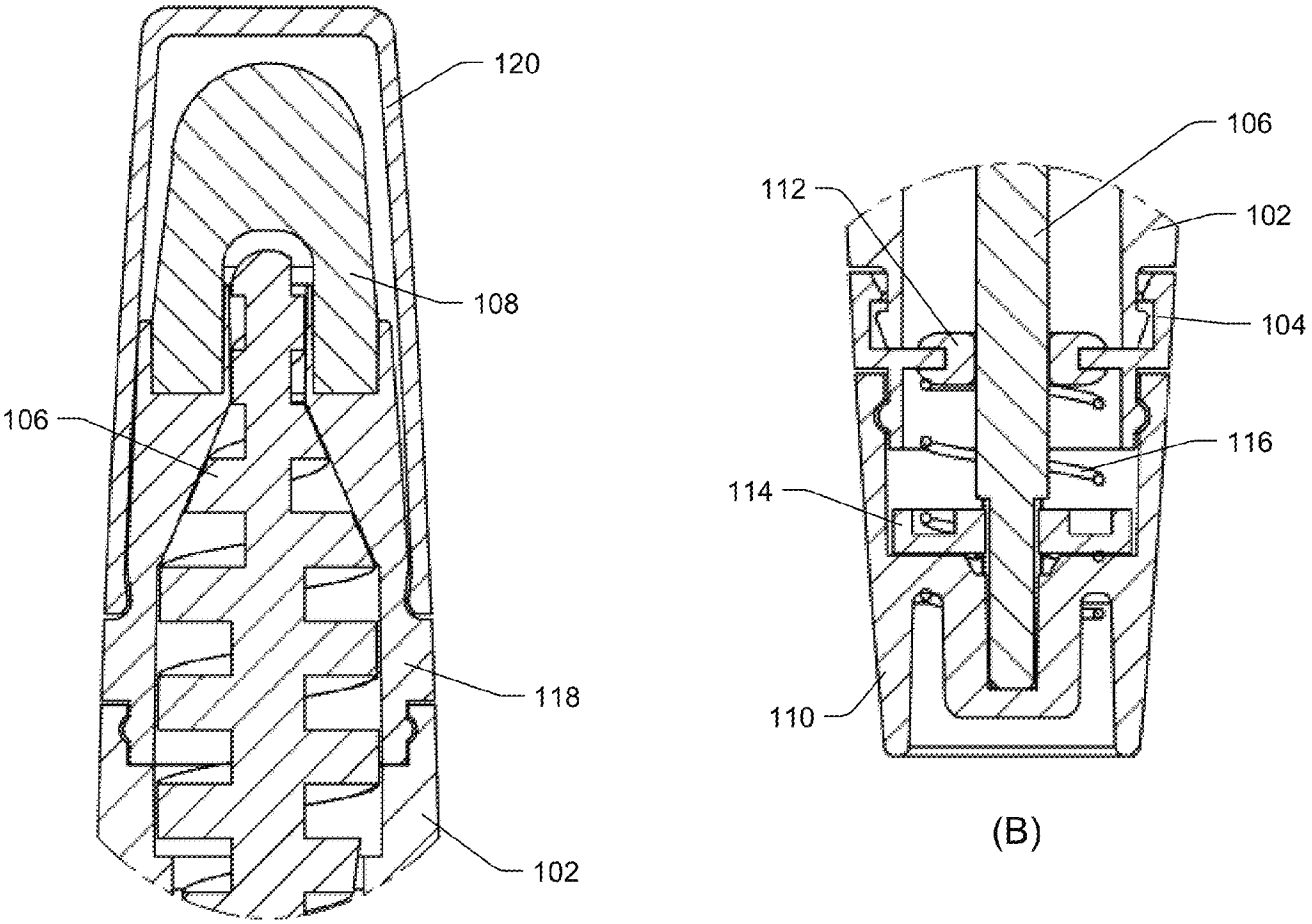
FIG. 4 includes two cross-sectional views, showing enlarged detail of the example applicator device of FIG. 3, the cross-sections taken along line 3-3 of FIG. 2.

Example embodiments of an applicator device are first described with reference to FIGS. 1-4. FIG. 1 includes a perspective view and an exploded view of an example applicator device 100, in which the techniques and devices in accordance with the present disclosure may be embodied. FIG. 2 includes plan and profile views of an example applicator device implemented as in FIG. 1. The views include a side view, a top view, and a bottom view. FIG. 3 is a cross-sectional profile view of an example applicator device implemented as in FIG. 1, taken along line 3-3 in FIG. 2. FIG. 4 includes two cross-sectional views (A) and (B), showing enlarged detail of the top or applicator end (A) and the bottom or end cap end (B) of the example applicator device of FIG. 3, the cross-sections taken along line 3-3 of FIG. 2.

For the purposes of this disclosure, the terms applicator device and dispenser may be used interchangeably, and are to be understood to mean a device for distributing (e.g., applying, dispensing, delivering, etc.) a product. Generally the product is stored in a local reservoir (e.g., container, chamber, cavity, compartment, storage, cell, etc.); however, a remote storage location is also included in some embodiments. It is to be understood that the techniques and/or devices described herein may be implemented as part of the illustrated applicator device 100, or as an accessory to or part of another system (for example as part of a larger or more complex product delivery system, etc.).

As shown in FIGS. 1-4, an example applicator device 100 may comprise a number of components. In some embodiments, the components may be coupled together using various techniques including using threaded couplings, press-fit couplings, rib and groove couplings, snap-fit couplings, and the like. Further, in some implementations, two or more of the components may be glued together or fastened together in a similar manner so as to be permanently fixed. In other implementations, components may be configured to be temporarily fixed or removable as desired. Additionally, as will be described below, some components may be configured to have at least partial freedom of motion with respect to other components.

In one embodiment, an applicator device 100 includes a reservoir 102 configured to contain a product. The reservoir 102 may be configured such that the product is not allowed to escape the reservoir 102 except as desired for distribution of the product. For example in one embodiment, the reservoir 102 may be sealed at a first end (e.g., the bottom end) of the reservoir 102. In one embodiment, the reservoir 102 itself may be designed and constructed to be sealed at the first end of the reservoir 102. In another embodiment, the reservoir 102 may be sealed using an end cap 104. For example, the end cap 104 may be coupled to the first end of the reservoir 102 to prevent the product from escaping the reservoir 102 from the first end. In various embodiments, the end cap 104 may be removably attached or permanently fixed to the first end of the reservoir 102. In one embodiment, the reservoir 102 is configured to be filled from the first end, the end cap 104 being coupled to the reservoir 102 after the reservoir 102 is filled.

In an embodiment, the applicator device 100 includes a feeder device (such as feeder screw 106) disposed within the reservoir 102 and configured to expel the product from a second end (e.g., the top end) of the reservoir 102. For example, the feeder device may be configured to expel the product from the reservoir 102 through the opposite end from the sealed end of the reservoir 102. In one embodiment, the feeder device is configured to expel the product from the second end of the reservoir 102 when the feeder device is advanced from a first position to a second position within the reservoir 102. Thus, in various embodiments, the feeder device is configured to have at least partial freedom of movement within the reservoir 102.

In one embodiment, as illustrated in FIGS. 1, 3, 4, and 5, the feeder device comprises a feeder screw 106. For example, the feeder screw 106 may comprise an auger, having helical-shaped blades. In other embodiments, the feeder device may be a piston device, plunger device, or other mechanical device or actuation/delivery mechanism. For the purposes of this application, the feeder device is discussed in terms of the feeder screw 106, but other feeder device embodiments as mentioned are also within the scope of the disclosure.

Figure 5:
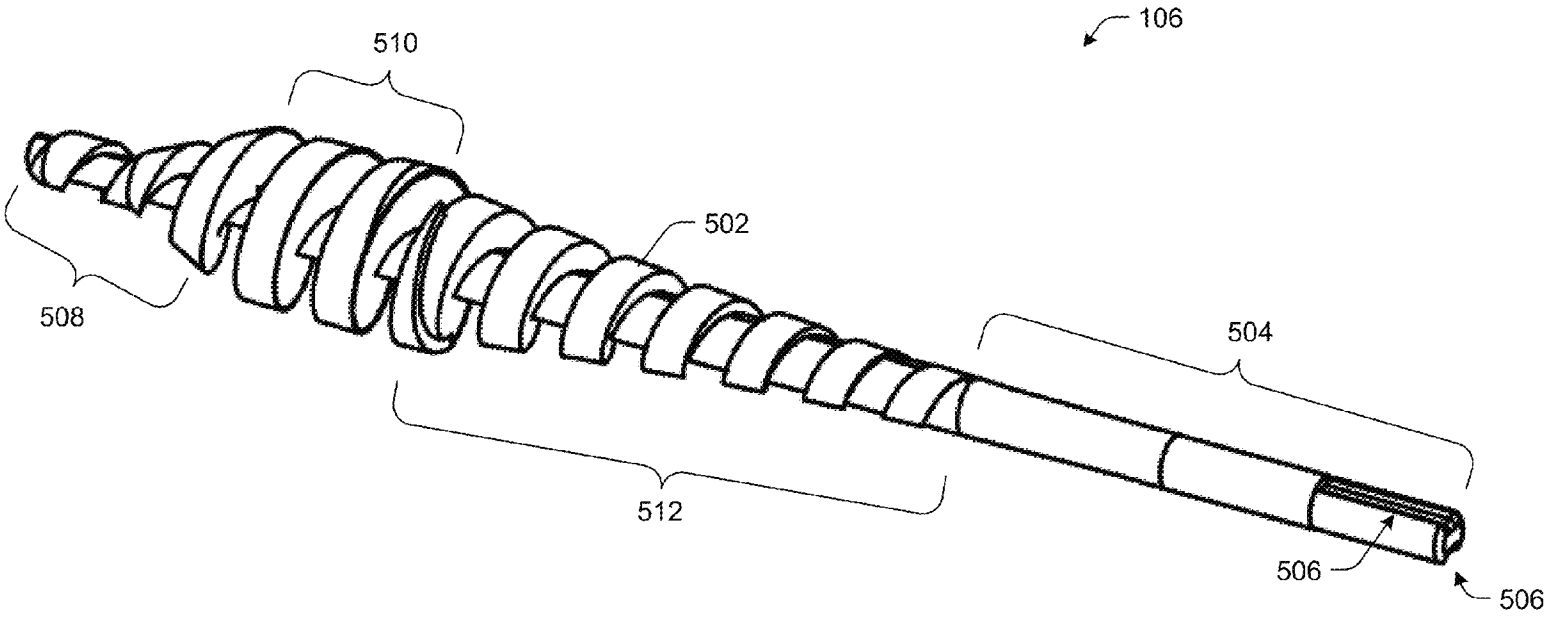
FIG. 5 is a perspective view of an example feeder device according to one embodiment. In the illustrated embodiment, the feeder device comprises a feeder screw having a tapered auger configuration.

In one embodiment, the feeder screw 106 is disposed within the reservoir 102 and configured to expel product from the second end of the reservoir 102 when the feeder screw is rotated. For example, a user may rotate the feeder screw 106, causing product to be expelled from the second end of the reservoir 102. In one embodiment, the interior of the reservoir 102 may be generally cylindrical in shape, and at least a portion of the feeder screw 106 may be disposed within the reservoir 102. As shown in FIGS. 3-5, the feeder screw 106 may be generally helical in shape and at least a portion of a periphery of the feeder screw 106 may comprise a substantially flat surface 502. The flat surface 502 may be configured to mate with at least a portion of an inner surface of the reservoir 102. In other words, an outer edge of at least some of the helical blades is generally flat and contacts the interior surface of the reservoir 102. In this way, the helical blades form a conveyor, pushing product through the reservoir 102 towards the second end (e.g., the top end) and out of the reservoir 102 when the feeder screw 106 is rotated. With the outer edge of a least some of the helical blades being substantially flat, the helical blades generally form a seal to the inner surface of the reservoir 102 that prevents or reduces product falling past the blades to the bottom of the reservoir 102.

In one implementation, as illustrated in FIG. 5, the feeder screw 106 may comprise an auger that includes a shaft 504 portion and a helical screw blade (comprising 508, 510, and 512) portion. As shown in the example implementation of FIG. 5, the shaft 504 of the feeder screw 106 may include one or more notches 506 to engage an actuator device for rotating the feeder screw 106, for example.

As illustrated in FIG. 5, the feeder screw 106 may be tapered at one or both ends. That is, a peripheral dimension of the feeder screw 106 becomes generally smaller toward one end or both ends of the feeder screw 106. In FIG. 5, blade portion 508 is tapered (e.g., becomes smaller in diameter) toward the top of the feeder screw 106 (towards the second end of the reservoir 102). Blade portion 510 is shown with several turns of the helical blade being generally the same diameter. In various embodiments, blade portion 510 may comprise one or more, or many, turns of the helical blade. The diameter of blade portion 510 is configured to substantially contact the inner surface of the reservoir 102. Blade portion 512 is tapered (e.g., becomes smaller in diameter) toward the bottom of the feeder screw 106 (towards the first end of the reservoir 102). In alternate embodiments, other profiles, tapers, and the like, may be used for feeder screw 106.

Figure 6:
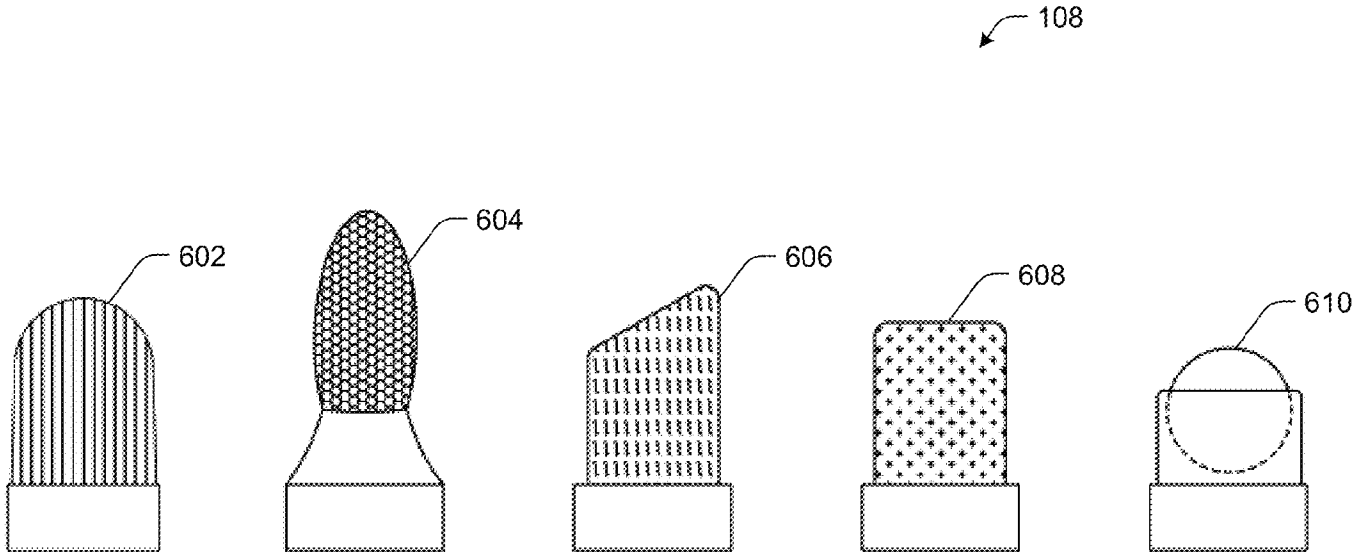
FIG. 6 illustrates several example applicators that may be implemented with an applicator device according to various embodiments.

In one embodiment, as illustrated in FIGS. 1, 3, and 4, the applicator device 100 includes an applicator 108. The applicator 108 may be coupled to the second end of the reservoir 102 for applying the product expelled from the reservoir 102. The applicator 108 may comprise any of various applicators that are used for applying powder or powder-like products to a surface, such as the surface of a user's face. Several example applicators 108 are illustrated in FIG. 6. Applicators 108 may include a brush 602, a swab tip 604, a flocked tip 606, a sponge tip 608, a rollerball 610, and the like. Such applicators 108 may also be used for other products, as described above, having various solid, semi-solid, and liquid forms. In one embodiment, the applicator 108 includes one or more openings that have access to the reservoir 102. For example, the one or more openings may be configured to expel the product from the reservoir 102.

In an embodiment, as illustrated in FIGS. 1-4, the applicator device 100 further includes a dial 110 coupled to the feeder screw 106. The dial 110 is configured to rotate the feeder screw 106 when the dial 110 is rotated. For example, a user may rotate the dial 110 to advance the feeder device (e.g., feeder screw 106) from a first position to a second position within the reservoir 102. In one embodiment, as illustrated in FIGS. 3 and 4, a portion of the feeder screw 106 protrudes through the end cap 104 and couples to the dial 110. In some embodiments, the portion of the feeder screw 106 that protrudes through the end cap 104 is at least a part of the shaft 504. In some embodiments, as illustrated in FIGS. 1, 3, and 4, the applicator device 100 may include one or more grommets 112, or the like, to further seal the reservoir 102 and/or the end cap 104.

In another embodiment, the applicator device 100 includes a push button device or mechanism (not shown) coupled to the feeder screw 106, and configured to rotate the feeder screw 106 when the push button is depressed. In other words, depressing the push button advances the feeder device from a first position to a second position within the reservoir 102. For example, a push button device or mechanism may be coupled to the end cap 104, or another portion of the applicator device 100 that is similar to an actuator mechanism used in a ballpoint pen, or the like. In other embodiments, other actuators, devices, or mechanisms may be used to advance the feeder device (e.g., rotate the feeder screw 106).

In one embodiment, as illustrated in FIGS. 1, 3, and 4, the applicator device 100 includes a click device 114 coupled to the dial 110. The click device 114 is configured to provide feedback to a user when the dial 110 is rotated. In various embodiments, the feedback to the user may include at least one of visual feedback, tactile feedback, and aural feedback. Visual feedback may include a sight in or on the body of the dial 110, where the user can see the click device 114 in relation to a mark or other reference object, for example. This reference can show the user how much the dial 110 (and thus the feeder screw 106) has been rotated.

Tactile feedback may include a tactile "click" that the user can feel as the dial 110 is rotated. In one embodiment, the user feels a click as the dial 110 is rotated a preset amount ($1/8^{th}$ of a revolution, for example). In this way, the dial 110 and the click device 114 operate to control rotation of the feeder screw 106. For example, the user has feedback regarding how much the user is rotating the feeder screw 106 during use. This can be helpful to the user to control the amount of product that is expelled from the reservoir 102, by gauging an amount of product with reference to one or more clicks of the dial 110.

Aural feedback may include an audible "click" that the user can hear as the dial 110 is rotated. In one embodiment, the user hears a click as the dial 110 is rotated a preset amount ($1/8^{th}$ of a revolution, for example). In various embodiments, the user may receive various combinations of the visual feedback, tactile feedback, and aural feedback. In alternate embodiments, the user may alternately or additionally receive other feedback based on the dial 110 and the click device 114.

Figure 7:
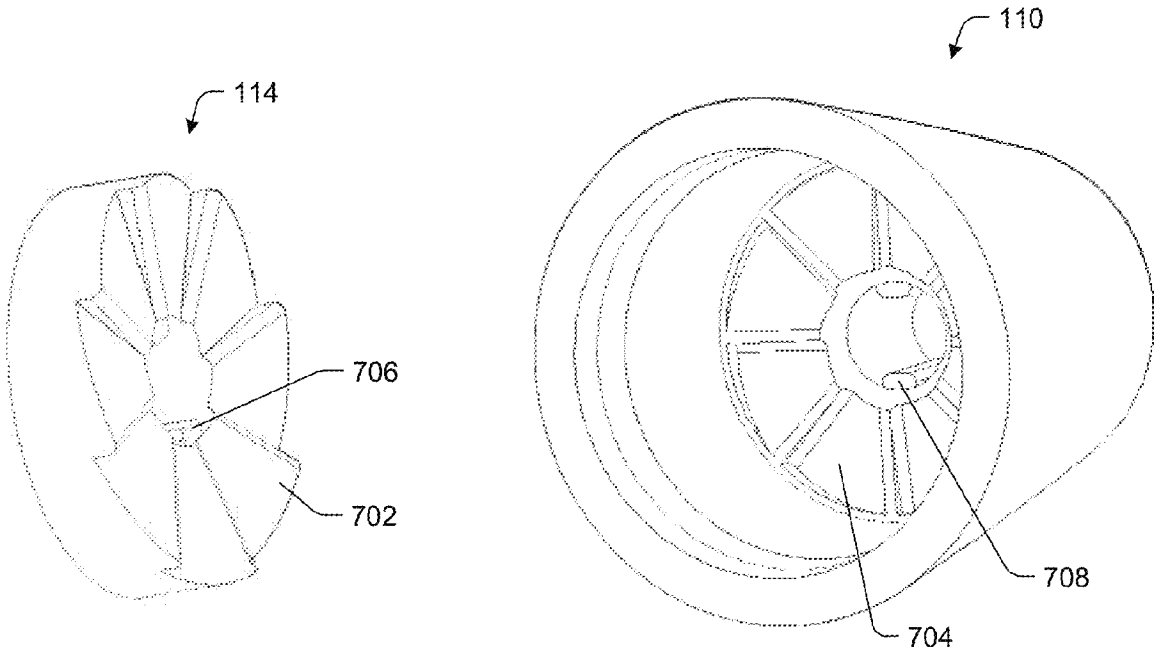
FIG. 7 includes perspective views showing details of an example click device and an example dial according to one embodiment.

In one embodiment, the click device 114 is compressed to a face of the dial 110 by a spring element 116. The spring element 116 may be configured to hold the click device 114 against the face of the dial 110 sufficient to produce the desired feedback from the click device 114 and still allow the dial 110 and the click device 114 to move with reference to each other. In one embodiment, as shown in FIG. 7, the click device 114 includes one or more protrusions 702 on at least the surface of the click device 114 that faces the dial 110. Further, the dial 110 includes one or more depressions 704 on the surface of the dial 110 that faces the click device 114. The protrusions 702 may be configured to engage the depressions 704 on the face of the dial 110, such that the "click" feedback is produced when the dial 110 turns with reference to the click device 114. The protrusions 702 and the depressions 704 may be generally wedge shaped, as shown in the illustration of FIG. 7, or they may have any other shape that would allow them to engage and produce the "click" feedback desired (e.g., hemispherical shape, polygonal shape, etc.).

If included, the dial 110 and/or the click device 114 may include tabs configured to engage one or more of the notches 506 of the shaft 504 of the feeder screw 106. Example tabs 706 (on the click device 114) and 708 (on the dial 110) are shown in FIG. 7. The tabs 706 and/or 708 may be included on the click device 114 and/or the dial 110 respectively, such that the shaft 504 of the feeder screw 106 and at least one of the click device 114 and the dial 110 rotate together. In that way, a user can rotate the dial 110 to rotate the feeder screw 106, for example. In FIG. 7, the tabs 706 and 708 are illustrated as being generally rectangular shaped. This is to match the illustration in FIG. 5 of the notches 506. In alternate embodiments, the tabs 706 and 708 and the notches 506 may be any shape that provides that they engage each other and securely couple the click device 114 and/or dial 110 to the shaft 504 of the feeder screw 106.

Figure 8:
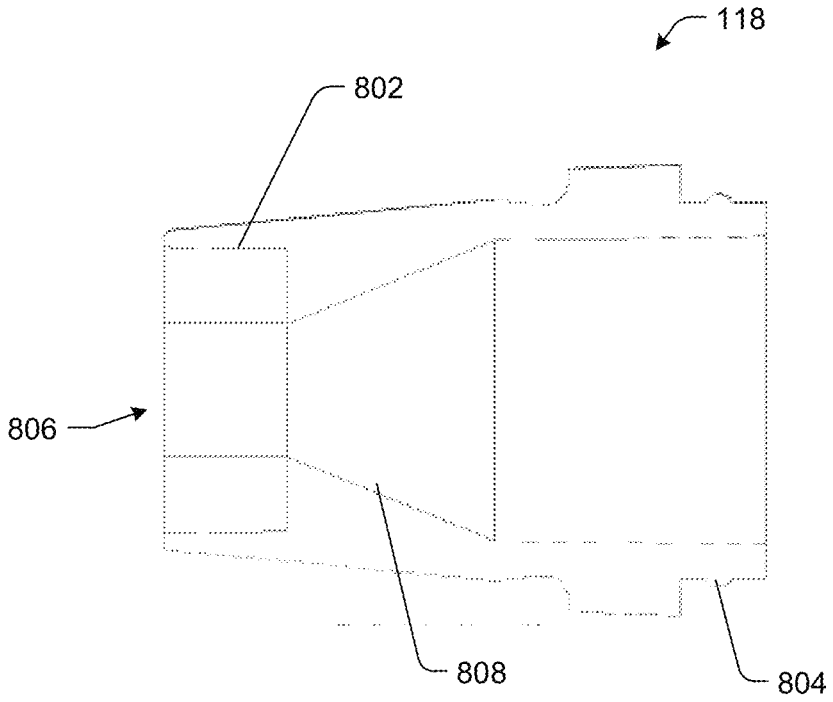
FIG. 8 is a cross-sectional profile view of an example applicator holder according to one embodiment, showing interior details.

In one embodiment, as illustrated in FIGS. 1-4, the applicator device includes an applicator holder 118 configured to couple the applicator 108 to the second end of the reservoir 102. An example applicator holder 118 is illustrated in FIG. 8. As shown in FIG. 8, the applicator holder 118 includes a mating surface 802 for receiving an applicator 108. In various implementations, the applicator 108 may be pressed into the applicator holder 118 and may be sealed, glued, threaded, or the like, such that the applicator 108 is permanently fixed to the applicator holder 118. In other embodiments, the applicator 108 may be pressed or fitted into the applicator holder 118 such that the applicator 108 is removable from the applicator holder 118.

In some embodiments, as shown in FIG. 8, the applicator holder 118 may include an exterior mating surface 804 for coupling the applicator holder 118 to the reservoir 102. For example, the exterior mating surface 804 may include threads, ribs, or the like, for coupling applicator holder 118 to the reservoir 102. In various embodiments, the applicator holder 118 provides an outlet 806 from the reservoir 102 for dispensing the product from the reservoir 102. In one embodiment, the applicator holder 118 includes an inner surface 808 that has a generally tapered conical configuration. Thus, the applicator holder 118 may also be referred to as a distribution conduit, a nozzle, or the like.

In one embodiment, as shown in FIGS. 1-4, the applicator device 100 includes a removable protective cover 120 configured to enclose the applicator 108 when the applicator 108 is not in use. Generally, the removable protective cover 120 is removed prior to using the applicator device 100, and replaced when finished. In alternate embodiments, the applicator 108 may protrude through an opening in the removable protective cover 120 for use of the applicator device 100, and retract when finished.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the invention.

What is claimed is:

1. An applicator device comprising:

a reservoir configured to contain a product;

an end cap coupled to a first end of the reservoir to prevent the product from escaping the reservoir from the first end;

a feeder screw disposed within the reservoir and configured to expel the product from a second end of the reservoir when the feeder screw is rotated;

a dial coupled to the feeder screw and configured to rotate the feeder screw when the dial is rotated;

a click device coupled to the dial and configured to provide feedback to a user when the dial is rotated, the feedback comprising at least one of visual feedback, tactile feedback, and aural feedback, wherein a shaft of the feeder screw includes one or more notches and at least one of the dial and the click device include one or more tabs to engage the one or more notches of the shaft of the feeder screw, such that the shaft of the feeder screw and the at least one of the dial and the click device rotate together; and an applicator coupled to the second end of the reservoir for applying the product expelled from the reservoir.

2. The applicator device of claim 1, wherein a portion of the feeder screw protrudes through the end cap and couples to the dial.

3. The applicator device of claim 1, wherein the click device is compressed to a face of the dial by a spring element, and wherein protrusions on the click device engage depressions on the face of the dial.

4. The applicator device of claim 1, wherein the dial and the click device operate to control rotation of the feeder screw.

5. The applicator device of claim 1, further comprising an applicator holder configured to couple the applicator to the second end of the reservoir, the applicator holder providing an outlet from the reservoir for dispensing the product.

6. The applicator device of claim 5, wherein the applicator holder includes an inner surface that has a generally tapered conical configuration.

7. The applicator device of claim 1, wherein an interior of the reservoir is generally cylindrical in shape.

8. The applicator device of claim 1, wherein the reservoir is configured to be filled from the first end, the end cap being coupled to the reservoir after the reservoir is filled.

9. The applicator device of claim 1, wherein the feeder screw comprises an auger.

10. The applicator device of claim 9, wherein the auger includes a helical screw blade and a shaft.

11. The applicator device of claim 1, wherein the feeder screw is generally helical in shape, at least a portion of a periphery of the feeder screw comprising a substantially flat surface configured to mate with at least a portion of an inner surface of the reservoir.

12. The applicator device of claim 1, wherein the feeder screw is tapered at one or both ends, a peripheral dimension of the feeder screw becoming generally smaller toward the one or both ends of the feeder screw.

13. The applicator device of claim 1, wherein the applicator comprises at least one of a brush, a swab, a sponge, a nozzle, a dropper, a wand, and a pad.

14. The applicator device of claim 1, wherein the applicator includes one or more openings with access to the reservoir, the one or more openings configured to expel the product from the reservoir.

15. The applicator device of claim 1, wherein the applicator is coupled to one of an applicator holder, a distribution conduit, or a nozzle.

16. The applicator device of claim 1, further comprising a removable protective cover configured to enclose the applicator when the applicator is not in use.

17. A dispenser comprising:

a reservoir configured to contain a product, the reservoir sealed at a first end to prevent the product from escaping the reservoir from the first end;

a feeder device disposed within the reservoir and configured to expel the product from a second end of the reservoir when the feeder device is advanced from a first position to a second position within the reservoir;

a nozzle coupled to the second end of the reservoir, providing a channel for the product to be expelled from the reservoir;

a dial coupled to the feeder device and configured to rotate the feeder device when the dial is rotated;

a click device coupled to the dial and configured to provide feedback to a user when the dial is rotated, the feedback comprising at least one of visual feedback, tactile feedback, and aural feedback, wherein a shaft of the feeder device includes one or more notches and at least one of the dial and the click device include one or more tabs to engage the one or more notches of the shaft of the feeder device, such that the shaft of the feeder device and the at least one of the dial and the click device rotate together; and an applicator coupled to the nozzle for applying the product expelled from the reservoir.

* * * * *